US005412213A

United States Patent [19]

Kido et al.

[11] Patent Number: 5,412,213

[45] Date of Patent: May 2, 1995

[54] CHARGER FOR PERFORMING A CORONA DISCHARGE

[75] Inventors: Eiichi Kido, Yamato-Koriyama; Yuhi Yui, Nabari; Shunju Anzai, Nara; Syoichiro Yoshiura, Yamato-Koriyama; Shinji Imagawa, Yao; Hiroaki Yoshida, Yamato-Koriyama; Yoshikazu Kawasaki, Kagoshima; Itaru Kawabata, Kashiba; Keizo Fukunaga, Ikoma; Toyokazu Mori, Yamato-Koriyama; Masaru Tsuji, Nara, all of Japan

[73] Assignee: Sharp Kabushiki Kaisha, Osaka, Japan

[21] Appl. No.: 54,058

[22] Filed: Apr. 29, 1993

[30] Foreign Application Priority Data

Jun. 26, 1992 [JP] Japan ..... 4-169134

[51] Int. Cl.[6] ..... H01T 19/04

[52] U.S. Cl. ..... 250/326; 250/325

[58] Field of Search ..... 250/324, 326, 325; 361/230, 229, 225; 430/902; 355/221

[56] References Cited

U.S. PATENT DOCUMENTS

| | | | |
|---|---|---|---|
| 2,965,755 | 5/1959 | West | 250/325 |
| 3,203,809 | 5/1962 | Visness et al. | 250/326 |
| 3,691,373 | 9/1972 | Compton et al. | 250/326 |
| 3,766,382 | 10/1973 | Lin | 250/326 |
| 4,538,204 | 8/1985 | Weber | 250/326 |
| 4,591,713 | 5/1986 | Gundlach et al. | 250/326 |
| 4,725,731 | 2/1988 | Lang | 250/326 |
| 4,725,732 | 2/1988 | Lang | 250/326 |

FOREIGN PATENT DOCUMENTS

| | | |
|---|---|---|
| 2363209 | 1/1975 | Germany . |
| 1388084 | 3/1975 | United Kingdom . |
| 2098792 | 11/1982 | United Kingdom . |

*Primary Examiner*—Jack I. Berman
*Assistant Examiner*—James Beyer

[57] ABSTRACT

A charger performs corona discharge by applying a voltage to a discharging electrode. The charger includes an electrode plate formed in the shape of a panel on the discharging electrode, a plurality of projecting portions disposed in an end portion of the electrode plate, and a plurality of projection groups formed in each of the projecting portions such that the projection groups are adjacent to each other in a thickness direction of the electrode plate.

4 Claims, 8 Drawing Sheets

CHARGER FOR PERFORMING A CORONA DISCHARGE

BACKGROUND OF THE INVENTION

1. Field of the Invention

The present invention relates to a charger for charging or discharging a recording medium for forming an image in electrostatic electrophotography. More particularly, the present invention relates to a charger for uniformly charging a surface of a recording medium by corona discharge in an image forming apparatus such as a copying machine, a printer, etc., and having a discharging electrode having a plurality of projections in the direction of a rotational axis of the recording medium.

2. Description of the Related Art

As is well known, an image forming apparatus using an electrostatic electrophotographic system is constructed by processing sections of charge, exposure, development, transfer, separation, cleaning and discharge. Namely, in a process for recording an image, a charger uniformly charges a surface of an image carrier as a recording medium formed on a conductive supporting body composed of e.g., an aluminum drum with respect to a rotated photoconductive layer. An optical image of an original image is next exposed onto the charged surface of the image carrier through an optical exposure device so that an electrostatic latent image according to this optical image is recorded on this carrier surface. Subsequently, toner is electrostatically attached to the electrostatic latent image on this image carrier and is then developed so that a toner image is formed on the image carrier surface. The toner image on the image carrier is then transferred onto a transfer material by a transfer device and is fixed by a fixing heater. Residual transfer toner left on the image carrier surface is removed therefrom by a cleaner and is collected in a predetermined collecting section. Residual charges are removed by a discharger from the image carrier surface after the cleaning operation to perform the next image forming operation.

For example, the recording medium as the image carrier is constructed by a photosensitive body in which an organic photo conductor (OPC) as the photoconductive layer is formed on the conductive drum. A corona discharger is generally used as a charger for providing charges for a surface of this recording medium in many cases.

In one corona discharger, a very thin conductive wire is covered with a conductive shield plate in a peripheral portion except for a shield portion opposite to the recording medium. A high voltage is applied to the wire so that corona discharge is caused to provide charges for charging by an electric current flowing through the recording medium. In another charger using corona discharge, a saw-toothed discharging electrode having many sharp projections arranged in line is disposed instead of the wire for corona discharge. A charging operation of this charger is performed by corona discharge from the sharp projections.

For example, the charger using the above saw-toothed discharging electrode (which is called a saw-toothed electrode in the following description) is proposed in specifications of the following patents.

(1) U.S. Pat. No. 4,591,713 (corresponding to Japanese Patent Application Laying Open (KOKAI) No. 60-158582)

(2) U.S. Pat. No. 4,725,731 (corresponding to Japanese Patent Application Laying Open (KOKAI) No. 63-14176)

(3) U.S. Pat. No. 4,725,732 (corresponding to Japanese Patent Application Laying Open (KOKAI) No. 63-15272)

(4) U.S. Pat. No. 3,691,373 (there is no corresponding Japanese Patent Application)

(5) British Pat. No. 1,388,084 (corresponding to Japanese Patent Application Laying Open (KOKAI) No. 49-8241)

In particular, charging characteristics are slightly influenced by a shape and an operating state of a discharging portion of each of saw-toothed electrodes at a forming stage thereof.

For example, when a saw-toothed electrode described in the above British Pat. No. 1,388,084 is formed, teeth of this electrode are formed by grinding in a manufacturing technique of the saw-toothed electrode having a zigzag shape. Accordingly, the charger is very expensive and it is difficult to stabilize dispersion in shape of the saw-toothed electrode.

In a charger described in the above U.S. Pat. No. 3,691,373, the point angle of a saw-toothed electrode is set to be steep when a discharging electrode is formed. Accordingly, great dispersion in height of the saw-toothed electrode having such a steep point angle is caused when a plurality of electrodes are formed in line.

In another general charger, distances between tip portions of saw-toothed electrodes and a grid electrode are different from each other. Therefore, impedances between the tip portions of the saw-toothed electrodes and the grid electrode are different from each other. Accordingly, discharging actions of the respective tip portions are different from each other on a recording medium surface so that no discharging operation can be uniformly performed. As a result, charging irregularities on the recording medium surface are caused.

A method for increasing a total electric current flowing through the saw-toothed electrodes is considered as a simple improving method for reducing these charging irregularities. However, when the total electric current is increased, a voltage applied to the saw-toothed electrodes is increased. A discharging electric current is increased when the voltage applied to the saw-toothed electrodes is increased. Therefore, an amount of ozone generated from a discharging portion is increased so that an image carrier surface is influenced by this ozone, thereby reducing the quality of an original image.

When the amount of ozone is increased, this ozone is bonded to various gases and foreign materials in the air floating within an image forming apparatus so that nitrogen oxides ($NO_X$), silicon oxides ($SiO_2$), etc. are generated. These oxides are attached onto surfaces of the saw-toothed electrodes and the grid electrode so that discharging ability of the saw-toothed electrodes and ability for controlling a charging potential of the grid electrode are reduced.

Further, it is necessary to prevent leak discharge from the tip portions of the saw-toothed electrodes to other unnecessary portions by an increase in applied voltage by increasing the total electric current. To prevent this leak discharge, it is necessary to excessively secure distances from discharging portions of the saw-toothed electrodes to a shield case. Therefore, the shield case is large-sized so that the charger is large-sized.

Further, when the saw-toothed electrodes are aged and cleaned at ends thereof, these electrode ends are rapidly worn and deteriorated when these electrode ends are steep. Accordingly, no saw-toothed electrodes can be practically used in such a case.

SUMMARY OF THE INVENTION

It is therefore an object of the present invention to provide a charger for stably performing corona discharge at any time by preferably changing the shape of a projecting portion constituting a saw-toothed electrode without increasing a voltage applied to the saw-toothed electrode as a discharging electrode.

In accordance with a first structure of the present invention, the above object can be achieved by a charger for performing corona discharge by applying a voltage to a discharging electrode and characterized in that the discharging electrode has an electrode plate formed in the shape of a panel and many projecting portions disposed in an end portion of the electrode plate, and a plurality of projection groups are formed in each of the projecting portions such that the projection groups are adjacent to each other in a thickness direction of the electrode plate.

In accordance with a second structure of the present invention, each of the projecting portions is constructed by the plurality of projection groups in the thickness direction of one electrode plate.

In accordance with a third structure of the present invention, the heights of projections in the plurality of projection groups for performing the corona discharge are different from each other.

In accordance with a fourth structure of the present invention, the above object can be also achieved by a charger for performing corona discharge by applying a voltage to a discharging electrode and characterized in that the discharging electrode is formed by an electrode plate having many projecting portions in an end portion of the discharging electrode, and each of the projecting portions has a shape having two ridgelines composed of a vertical ridgeline formed in a direction approximately perpendicular to both sides of the electrode plate and a horizontal ridgeline approximately parallel to both the sides of the electrode plate.

In the charger of the present invention, when a high voltage for performing corona discharge is applied to the discharging electrode, the corona discharge is caused from each of the projecting portions. Thus, an electric current of the corona discharge as a total electric current flows onto a side of the discharging electrode. At this time, a portion of the discharging electric current also flows onto the side of a recording medium so that a surface of the recording medium is charged with electricity having a predetermined polarity.

In the charger having the first structure, a plurality of projection groups are formed in each of the projecting portions. Accordingly, a large amount of the discharging electric current flows out of one specified projecting tip. If this projecting tip is deteriorated, a large amount of the discharging electric current flows out of the other projecting tips. Thus, the corona discharge using one projection is gradually changed to corona discharge using another projection. Therefore, a corona discharging state is stabilized at any time.

In the charger having the second structure, the plurality of projection groups are formed by one electrode plate in each of the projecting portions so that the charger can be simply assembled.

In the charger having the third structure, the heights of projections in the projection groups are different from each other. Accordingly, a large portion of the corona discharge is first caused from a highest projection. When an amount of the corona discharge from this highest tip projection is gradually decreased by continuous corona discharge, an amount of the corona discharge from another projection is gradually increased so that a stable discharging operation can be continuously performed for a long time.

In the charger having the fourth structure, a plurality of ridgelines are formed in each of the projecting portions. Accordingly, when a tip projection for corona discharge is eroded by using this tip projection for a long time, a projection is formed on one of the plural ridgelines. The corona discharge is caused from this formed projection so that the corona discharge can be performed for a long time.

Further objects and advantages of the present invention will be apparent from the following description of the preferred embodiments of the present invention as illustrated in the accompanying drawings.

BRIEF DESCRIPTION OF THE DRAWINGS

FIG. 8*a* to 8*d* are enlarged views for enlarging the tip portion of the discharging electrode in FIG. 7 in which FIG. 8*a* is a front view of the tip portion seen from a thickness direction of an electrode plate, FIG. 8*b* is a side view of the tip portion, FIG. 8*c* is a cross-sectional view of the tip portion seen in a direction X–X′ in FIG. 8*b*, and FIG. 8*d* is an enlarged view of the tip portion shown in FIG. 8*c;*

DESCRIPTION OF THE PREFERRED EMBODIMENTS

The preferred embodiments of a charger in the present invention will next be described in detail with reference to the accompanying drawings.

Figure 1:
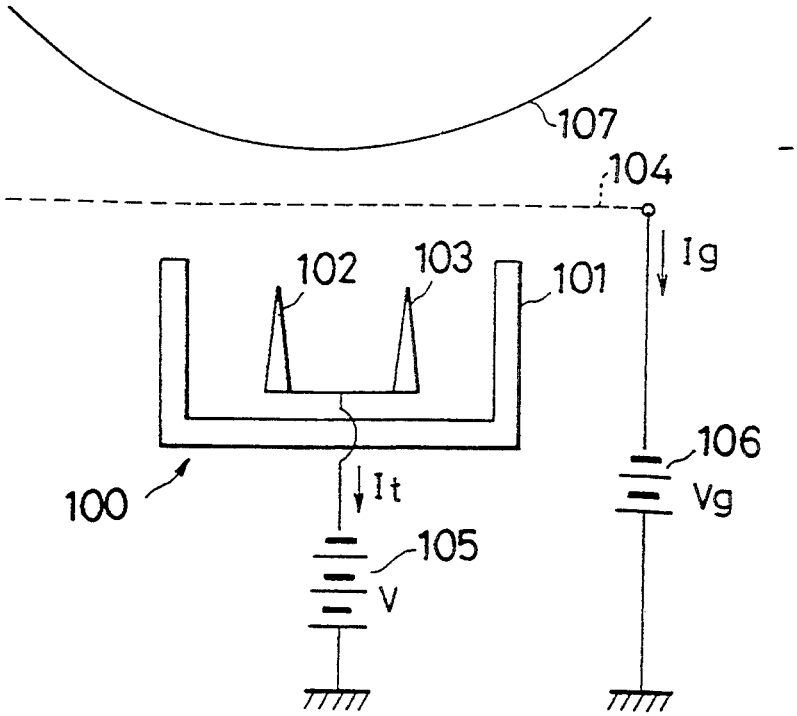
Fig. 1 PRIOR ART
FIG. 1 is a view for explaining a general charger having saw-toothed electrodes.

FIG. 1 shows the schematic structure of a charger described in U.S. Pat. No. 4,591,713. Two saw-toothed electrodes 102 and 103 are parallel to each other and are arranged and held within an insulating shield case 101. A photosensitive drum 107 is arranged as a recording medium on a front face of the shield case 101. The charger also has a conductive grid electrode 104 having a net shape and arranged in a position opposite to the photosensitive drum 107. The conductive grid electrode 104 is used to charge a surface of the photosensitive drum 107.

A charger described in U.S. Pat. No. 4,725,731 has a means for supporting the saw-toothed electrode 102 in the charging structure shown in FIG. 1. An opening portion is disposed in this supporting means to form a corona-like flow by corona discharge. In this charger, ozone caused by the corona discharge is collected within the shield case 101 so that charging irregularities are caused by deteriorations of the photosensitive drum 107 and the saw-toothed electrode 102, etc. The corona flow is generated to prevent such charging irregularities so that this ozone is discharged from the shield case.

A charger described in U.S. Pat. No. 4,725,732 shows a structure for supporting the saw-toothed electrode 102 and the shield case 101 by the same supporting member in the charging structure shown in FIG. 1.

A charger described in U.S. Pat. No. 3,691,373 shows a technique in which a metallic plate is dipped into etching liquid to form the saw-toothed electrodes 102 and 103. In this charger, the metallic plate has a thickness selectively ranged from 0.200 to 0.400 inches. A point angle of a sharp projection of each of the saw-toothed electrodes is set to 5° to 30°.

A charger described in British Pat. No. 1,388,084 also shows a saw-toothed electrode. The saw-toothed electrode is especially formed by a plate having a thickness from 0.1 mm to 0.6 mm and projections arranged at a pitch from 1 mm to 6 mm. The thicknesses 0.1 to 0.6 mm respectively correspond to the pitches 1 to 6 mm. These projections are formed in a zigzag shape.

As mentioned above, in the charger 100 having the charging structure shown in FIG. 1, a predetermined voltage is applied by a power source 105 to each of the saw-toothed electrodes 102 and 103. A grid voltage Vg For controlling a corona electric current is applied by a power source 106 to the grid electrode 104. The corona electric current is discharged from a tip portion of each of the saw-toothed electrodes 102 and 103 onto a surface of the photosensitive drum 107. At this time, an electric current flowing through each of the saw-toothed electrodes 102 and 103 is a total electric current It. An electric current flowing through the grid electrode 104 is a grid current Ig.

In particular, charging characteristics are slightly influenced by a shape and an operating state of a discharging portion of each of the saw-toothed electrodes at a forming stage thereof.

For example, when the saw-toothed electrode described in the above British Pat. No. 1,888,084 is formed, teeth of this electrode are formed by grinding in a manufacturing technique of the saw-toothed electrode having the zigzag shape. Accordingly, the charger is very expensive and it is difficult to stabilize dispersion in shape of the saw-toothed electrode.

In the charger described in the above U.S. Pat. No. 8,691,878, the point angle of a saw-toothed electrode is set to be steep when a discharging electrode is formed. Accordingly, great dispersion in height of the saw-toothed electrode having such a steep point angle is caused when a plurality of electrodes are formed in line.

Figure 2:
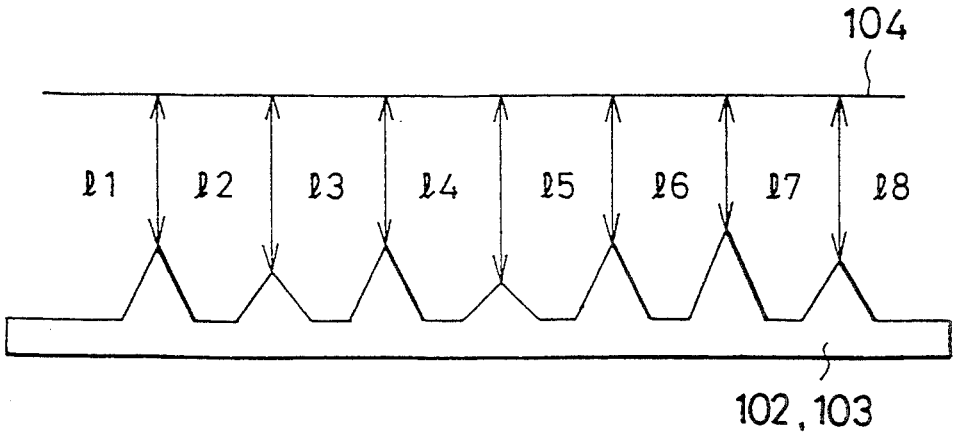
Fig. 2 PRIOR ART
FIG. 2 is a plan view for explaining the relation in distance between the saw-toothed electrodes and a grid electrode in the charger shown in FIG. 1.

FIG. 2 is a view for explaining problems in a forming state of a discharging electrode in the charger 100. FIG. 2 shows a state in which no heights of tip portions of the saw-toothed electrodes 102 and 103 are uniformly set. FIG. 2 also shows a state in which the grid electrode 104 is tensioned by tensile force. Irregular heights of the tip portions are caused by dispersion in manufacturing process of each of the saw-toothed electrodes and the grid electrode. At this time, distances l 1 to l 8 between the tip portions of the saw-toothed electrodes 102, 103 and the grid electrode 104 are different from each other. Therefore, impedances between the tip portions of the saw-toothed electrodes 102, 103 and the grid electrode 104 are different from each other. Accordingly, discharging actions of the respective tip portions are different from each other on a recording medium surface so that no discharging operation can be uniformly performed. As a result, charging irregularities on the recording medium surface are caused.

A method for increasing the total electric current It flowing through the saw-toothed electrodes 102 and 103 is considered as a simple improving method for reducing these charging irregularities. However, when the total electric current It is increased, a voltage applied to the saw-toothed electrodes 102 and 103 is increased. A discharging electric current is increased when the voltage applied to the saw-toothed electrodes 102 and 103 is increased. Therefore, an amount of ozone generated from a discharging portion is increased so that an image carrier surface is influenced by this ozone, thereby reducing the quality of an original image.

When the amount of ozone is increased, this ozone is bonded to various gases and foreign materials in the air floating within an image forming apparatus so that nitrogen oxides ($NO_X$), silicon oxides ($SiO_2$), etc. are generated. These oxides are attached onto surfaces of the saw-toothed electrodes and the grid electrode so that discharging ability of the saw-toothed electrodes and ability for controlling a charging potential of the grid electrode are reduced.

Further, it is necessary to prevent leak discharge from the tip portions of the saw-toothed electrodes 102 and 108 to other unnecessary portions by an increase in applied voltage V by increasing the total electric current It. To prevent this leak discharge, it is necessary to excessively secure distances from discharging portions of the saw-toothed electrodes 102 and 108 to the shield case 101. Therefore, the shield case 101 is large-sized so that the charger 100 is large-sized.

Further, when the saw-toothed electrodes 102 and 103 are aged and cleaned at ends thereof, these electrode ends are rapidly worn and deteriorated when these electrode ends are steep. Accordingly, no saw-toothed electrodes can be practically used in such a case.

Figure 3:
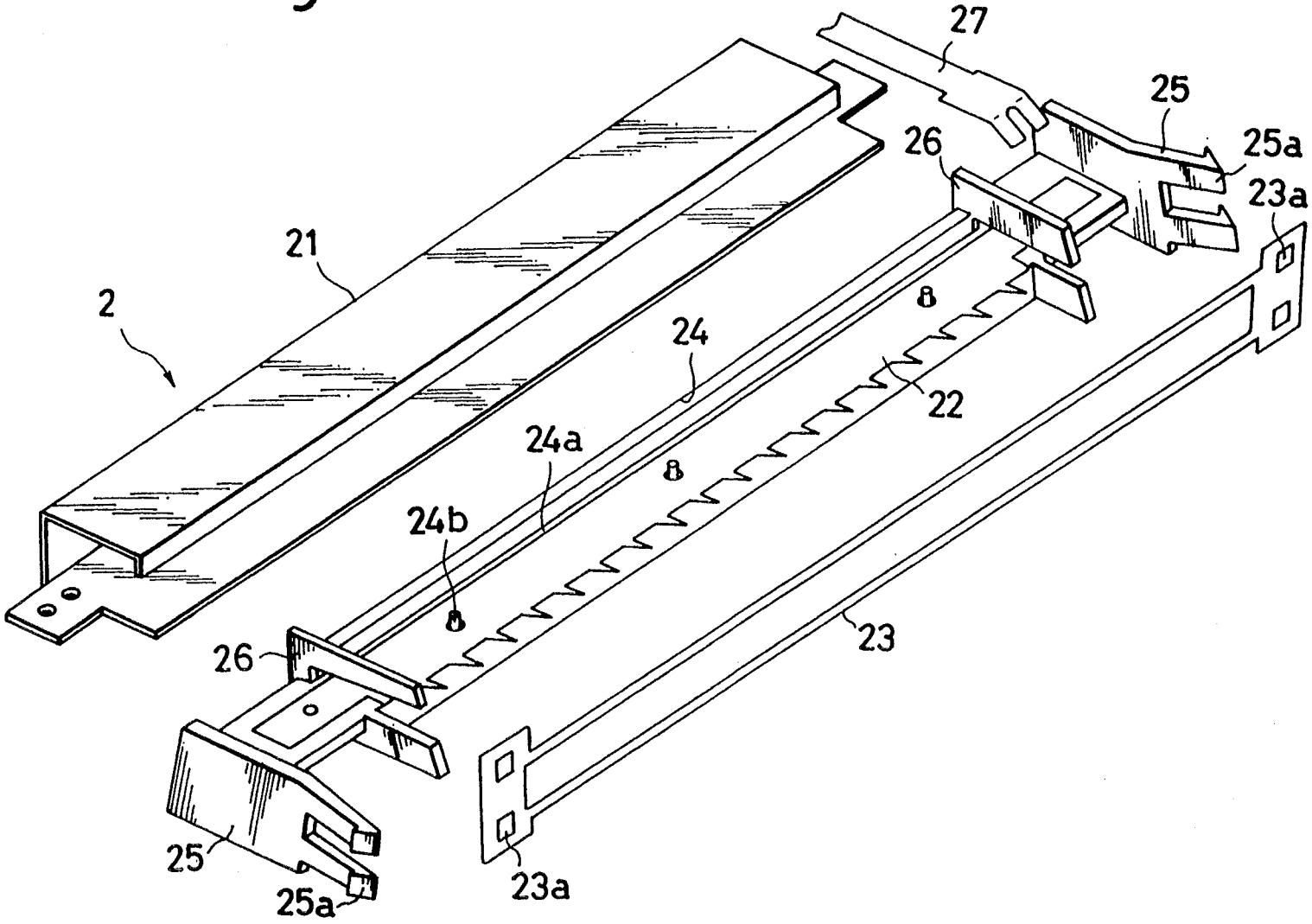
FIG. 3 is an exploded perspective view of a charger in accordance with one embodiment of the present invention.
Figure 4:
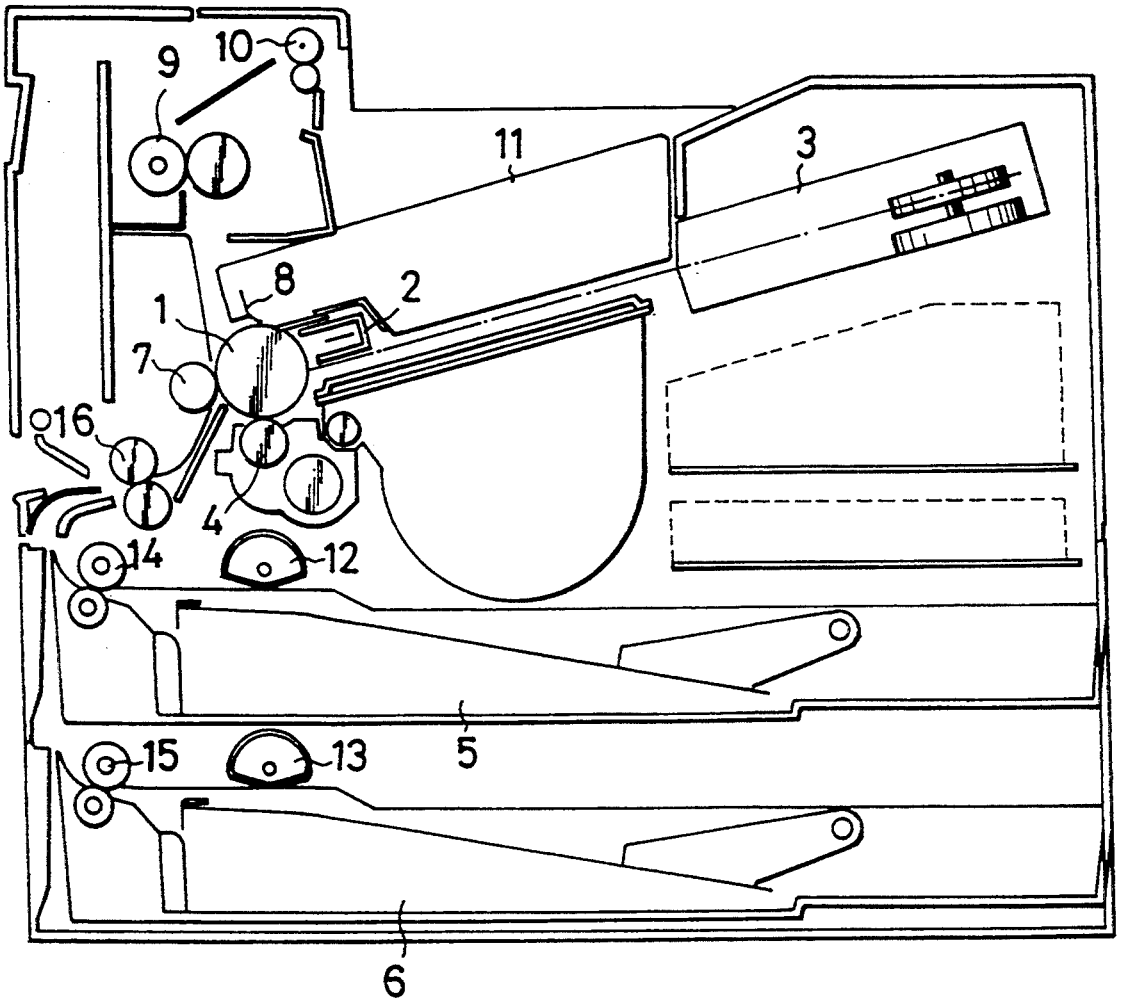
FIG. 4 is a cross-sectional view showing the internal structure of an image forming apparatus having the charger in the present invention.

FIG. 3 is an exploded perspective view showing the concrete structure of a charger in the present invention. FIG. 4 is a cross-sectional view showing the internal structure of an image forming apparatus such as a laser printer having the charger in the present invention.

In the image forming apparatus shown in FIG. 4, a photosensitive drum 1 is arranged in a central portion on a left-hand side of the image forming apparatus. For example, the photosensitive drum 1 is formed by using a layer of an organic photo conductor (OPC) as a photoconductive layer on an aluminum drum as described before. Each of constructional units for forming an electrophotographic process is arranged around this photosensitive drum 1 as a center such that these constructional units are opposed to the photosensitive drum 1. A charger 2 in the present invention is arranged around the photosensitive drum 1 and uses corona discharge for uniformly charging the photosensitive drum 1. An optical recording section 3 irradiates a laser beam for exposing and recording an original image onto a surface of the photosensitive drum 1 uniformly charged by the charger 2. A developing device 4 develops an electrostatic latent image formed on the photosensitive drum 1 by the optical recording section 3 by using toner. A transfer device 7 transfers a toner image formed on the photosensitive drum 1 by the developing device 4 onto a surface of a transfer material such as paper fed from one of paper storing sections 5 and 6. A cleaner 8 removes and collects residual toner partially left on the photosensitive drum 1 without transfer of the toner image from the photosensitive drum 1 to the transfer material by the transfer device 7.

The toner image as an original image transferred onto the transfer material by the transfer device 7 is fed to a fixing heater 9 and is fixed onto the transfer material by heat and pressure. Thus, the transfer material having the toner image is discharged through a paper discharging roller 10 onto a paper discharging tray 11 in an upper portion of the image forming apparatus.

The paper storing sections 5 and 6 are detachably disposed in a body of the image forming apparatus. Paper feed rollers 12 and 13 are respectively opposed to the paper storing sections 5 and 6. The transfer material fed by each of the paper feed rollers 12 and 13 is fed toward a resist roller 16 by each of conveying rollers 14 and 15. The resist roller 16 temporarily stops a movement of the fed transfer material and controls a starting operation of conveyance of the transfer material in synchronization with rotation of the photosensitive drum 1. In particular, the resist roller 16 controls the starting operation of conveyance of a piece of paper such that a front end of the image formed on the photosensitive drum 1 is in conformity with a front end of the transfer material.

FIG. 3 shows one example of the concrete construction of the charger 2 in the present invention. The charger 2 is constructed by a conductive shield case 21, a saw-toothed electrode 22, a grid electrode 23 and an insulating electrode holding member 24 for holding various kinds of electrodes.

In FIG. 3, the shield case 21 is constructed by a conductive shield plate having a length approximately equal to a width of the photosensitive drum 1 in the direction of a rotational axis thereof. The shield case 21 is opened on a side opposite to a surface of the photosensitive drum 1. The saw-toothed electrode 22 has a plurality of sharp projections for discharge arranged in line at a predetermined pitch. The saw-toothed electrode 22 is constructed by a thin plate formed in the shape of a short strip and made of stainless steel such as an alloy of ion, chromium and nickel. For example, this alloy is constructed by SUS304 in Japanese Industrial Standard (JIS). Such a saw-toothed electrode 22 is formed by etching processing.

The saw-toothed electrode 22 has a plurality of openings for fixing the saw-toothed electrode 22. Each of these openings is fitted onto a projecting portion 24*b* formed in a planar shape portion 24*a* of the electrode holding member 24 integrally formed by an insulating member. Thus, the saw-toothed electrode 22 is positioned, fixed and held by the shield case 21 in an electrically insulated state in the planar shape portion 24*a* of the electrode holding member 24.

A grid electrode holding portion 25 is integrally formed in the electrode holding member 24. The grid electrode holding portion 25 electrically insulates and holds the grid electrode 28 with respect to the shield case 21 and the saw-toothed electrode 22. This grid electrode holding portion 25 has an engaging portion 25*a* having a returning portion for engagement and corresponding to an opening portion 28*a* formed at each of both ends of the grid electrode 28. When this grid electrode holding portion 25 is elastically deformed, the engaging portion 25*a* is inserted into the opening portion 28*a* of the grid electrode 28. When this elastic deformation of the grid electrode holding portion 25 is released, the grid electrode 28 is held by elastic force of the grid electrode holding portion 25 as predetermined tensile force.

The above grid electrode 28 has openings having a mesh shape and uniformly formed by etching a thin plate. This thin plate is formed in the shape of a short strip and is made of stainless steel as in the above saw-toothed electrode 22. The grid electrode holding portion 25 integrally molded with the electrode holding member 24 is elastically deformed so that the engaging portion 25*a* is inserted into an opening formed in the grid electrode 28 and is engaged with this opening. Thus, the grid electrode holding portion 25 is tensioned by elastic force.

A positioning member 26 is integrally molded with the electrode holding member 24 and is arranged in accordance with each of both end edges of the shield case 21. The positioning member 26 is used to position the electrode holding member 24 within the shield case 21.

When a corona discharger having the above structure is assembled, a projection of the planar shape portion 24*a* of the electrode holding member 24 is first fitted into an opening formed in the saw-toothed electrode 22 so that the saw-toothed electrode 22 is held by this projection. The positioning member 26 is positioned and stored at an end edge of the shield case 21 in a predetermined position within the above shield case 21 in a state in which the saw-toothed electrode 22 is held. The engaging portion 25*a* of the grid electrode holding portion 25 is inserted into the opening portion 23*a* of the grid electrode and is engaged with this opening portion 23*a*. A spring terminal 27 for power supply electrically comes in elastic contact with an end portion of the saw-toothed electrode 22 located in the electrode holding member 24 and projected from the shield case.

In the charger 2 having the above structure, when a predetermined high voltage is applied to the saw-toothed electrode 22, corona discharge is caused from a tip of each of the sharp projections formed and arranged at an equal pitch. At this time, a portion of an electric current of the corona discharge flows onto a side of the photosensitive drum 1 so that a surface of the photosensitive drum 1 is charged with electricity having a specific polarity. For example, a charging potential can be freely set by controlling a voltage applied to the grid electrode 23, etc. Each of the projecting portions of the charger in the present invention is constructed by a group of projections.

A method for forming a group of projections in each of the projecting portions in the saw-toothed electrode 22 as a discharging electrode will next be described in detail.

Figure 5A:
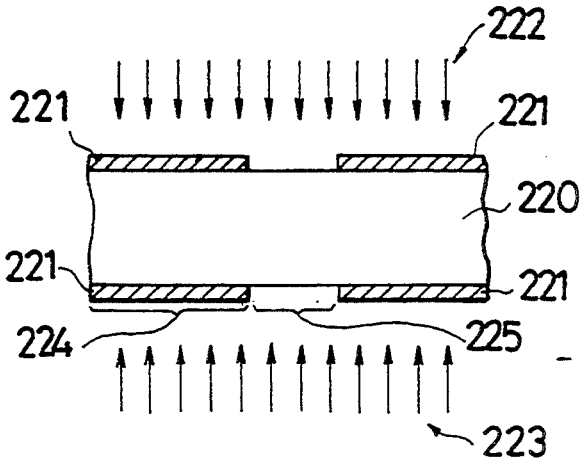
FIGS. 5*a* to 5*d* are cross-sectional views for explaining a manufacturing method of a discharging electrode constituting the charger in the present invention and sequentially showing manufacturing processes of the discharging electrode.

FIGS. 5*a* to 5*d* sequentially show manufacturing processes of the plural projections. In FIG. 5*a*, stainless steel (SUS304) is used as a material of the saw-toothed electrode 22 to Form many projections in an electrode plate. An electrode plate 220 is made of stainless steel having a thickness of 0.1 mm. A masking agent 221 is printed on both faces of the electrode plate 220 so that a masked portion 224 and an unmasked portion 225 are formed. Etching liquid is blown from above as shown by arrows 222 and is blown from below as shown by arrows 223.

Figure 5B:
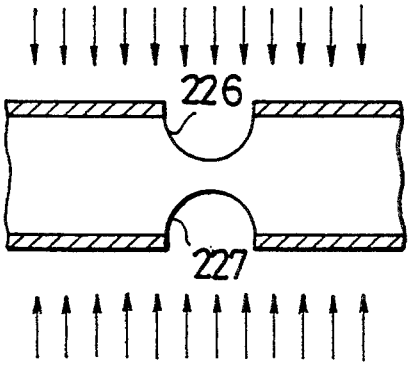
Figure 5C:
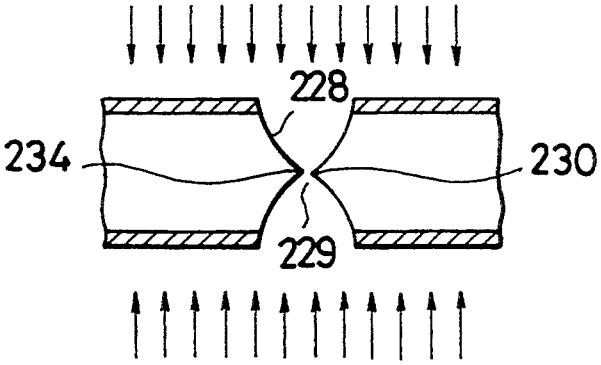
Figure 5D:
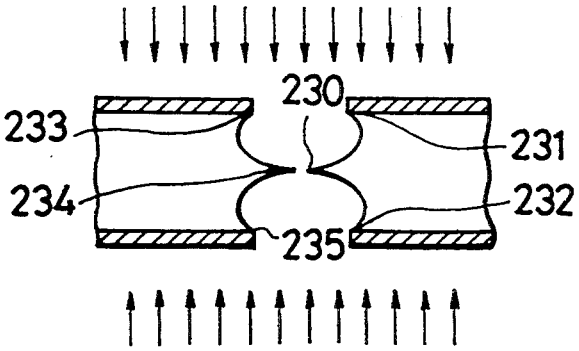

FIG. 5*b* shows a state in which an etching operation is performed for a predetermined time in a state shown in FIG. 5*a*. The unmasked portion 225 of the electrode plate 220 is etched by the etching liquid as shown by etched portions 226 and 227. When a predetermined time has further passed, the etched portions 226 and 227 are connected to each other as shown in FIG. 5*c* so that a through portion 229 is formed. At this time, first tip portions 230 and 234 as projecting portions are formed on both sides of the through portion 229. When the etching operation is further continuously performed for a predetermined time, heights of the tip portions 230 and 234 become low as shown by FIG. 5*d*. Thus, second tip portions 231 and 233 as projecting portions and third tip portions 232 and 235 as projecting portions are formed.

FIGS. 6*a* to 6*f* are cross-sectional views showing shapes of the formed tip projections. FIGS. 6*a* to 6*f* show various kinds of sectional tip projections in a direction perpendicular to a thickness direction of the electrode plate in an end portion of the saw-toothed electrode 22. The relation between sectional differences and discharging characteristics will next be described in detail.

Figure 6A:
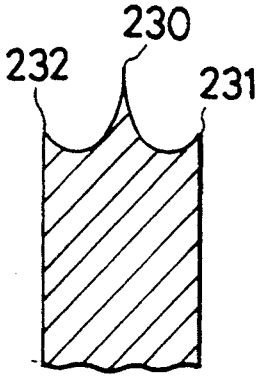
FIGS. 6*a* to 6*f* are cross-sectional views for explaining and showing shapes of discharging tips of the discharging electrode.
Figure 6B:
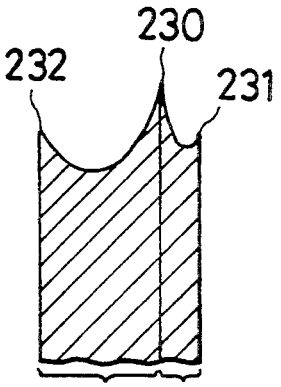

Each of FIGS. 6*a* and 6*b* shows a discharging electrode having a first tip portion 230, a second tip portion 231 and a third tip portion 232 in one of many projecting portions formed in the manufacturing process shown in FIG. 5*d*.

In FIG. 6*a*, the first tip portion 230 is approximately formed in a central position between the second tip portion 231 and the third tip portion 232. In FIG. 6*b*, the discharging electrode has a shape formed when etching conditions on both sides of the electrode plate are different from each other. In FIG. 6*b*, the first tip portion 230 is located in a position in which a ratio of distances from both side faces of the electrode plate 220 is set to 7:3.

Figure 6C:
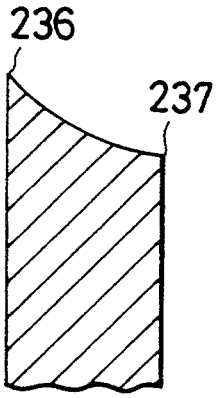
Figure 6D:
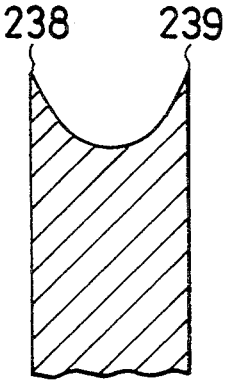

In FIG. 6*c*, a tip portion 236 is formed on a side face of the electrode plate. In FIG. 6*d*, no first tip portion 230 is formed and a second tip portion 238 and a third tip portion 239 are formed.

The shape of the discharging electrode shown in FIG. 6*d* is formed when the etching liquid is strongly blown to the electrode plate from a manufacturing process state shown in FIG. 5*b*.

Figure 6E:
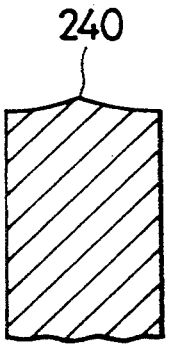

FIG. 6*e* shows the shape of a tip portion 230 of the electrode plate when the etching operation is continuously performed for a predetermined time from a manufacturing process state shown in FIG. 5*d*. In FIG. 6*e*, a height of the tip portion 230 is very low.

Figure 6F:
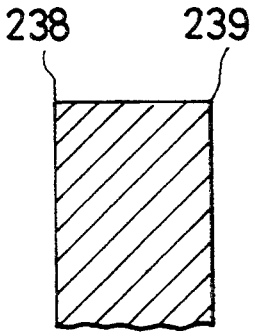

FIG. 6*f* shows a state in which the first tip portion 230 is etched and a second tip portion 238 and a third tip portion 239 are slightly formed when the etching operation is further continuously performed for a predetermined time from the manufacturing process state shown in FIG. 6*e*.

The relation between the shapes of the tip portions shown in FIGS. 6*a* to 6*f* and discharging characteristics will next be explained.

When a predetermined voltage is applied to the discharging electrode shown in each of FIGS. 6*a* and 6*b*, a discharging operation is first performed in the most projected first tip portion 230. A discharging electric current slightly flows out of each of the second tip portion 231 and the third tip portion 232. When the first tip portion 230 is used for a long time, silicon oxide is attached to the first tip portion 230 and grows as whiskers. The first tip portion 230 is covered with the whiskers as the whiskers grow, thereby reducing a discharging electric current. When the discharging operation is further performed continuously, the first tip portion 230 is etched by ions of nitrogen, etc. and the discharging electric current is further reduced by an influence of the above whiskers. When the discharging electric current from the first tip portion 230 is reduced, a discharging electric current from the second tip portion 231 or the third tip portion 232 is increased so that the discharging operation is performed in the plural tip portions.

When the discharging operation is further performed continuously, the discharging electric current from the second tip portion 231 or the third tip portion 232 is also reduced by whiskers and etching caused by ions of nitrogen. The first tip portion 230, the second tip portion 231 and the third tip portion 232 are normally beaten by a cleaning member formed in the shape of a brush to remove the whiskers therefrom and clean these tip portions before the discharging electric current is reduced or when the discharging electric current is reduced. The discharging operation can be again performed after the cleaning operation unless there are no tip portions by etching caused by ions of nitrogen, etc.

In FIG. 6*c*, a single tip portion 236 is formed. Accordingly, when the discharging operation is performed for a long time, defective discharge is caused for a short time in comparison with the cases of FIGS. 6*a* and 6*b*.

In FIGS. 6*d*, two tip portions are formed so that the discharging operation is stably performed in comparison with the case of FIG. 6*c*. However, defective discharge is caused for a short time in comparison with the cases of FIGS. 6*a* and 6*b*.

In each of FIGS. 6*e* and 6*f*, the height of a tip portion is very low so that a voltage for starting the discharging operation is high. Accordingly, a large amount of ozone is generated so that it is not suitable for manufacture of a compact charger.

Figure 7:
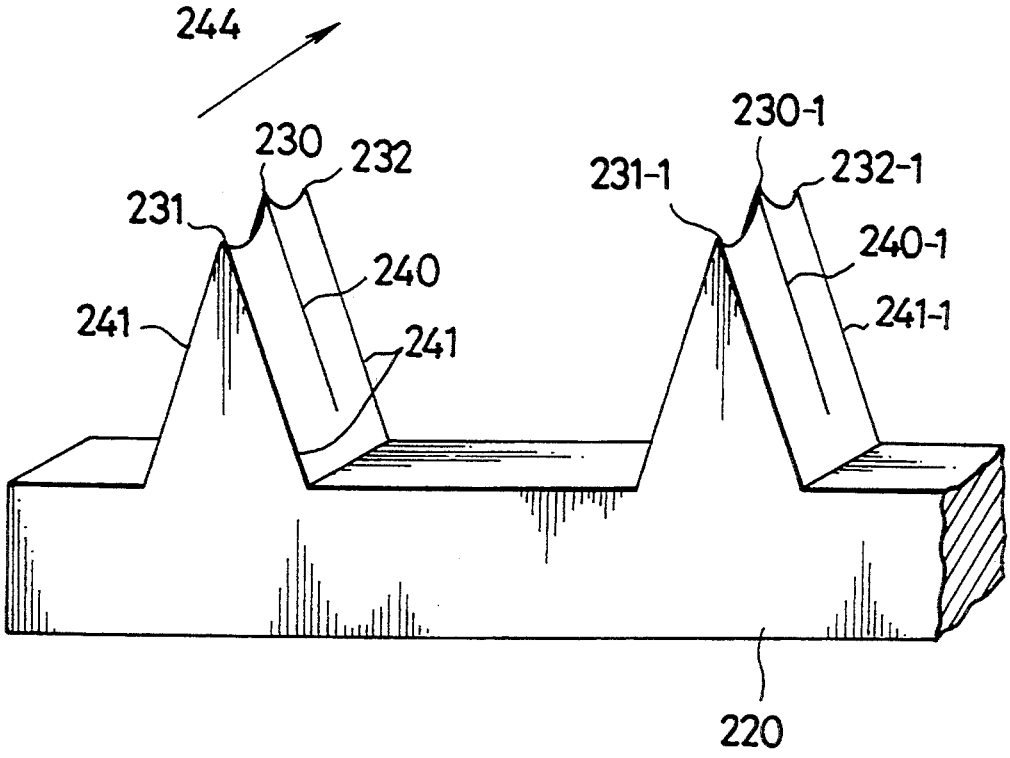
FIG. 7 is a detailed perspective view showing a tip portion of the discharging electrode shown in FIGS. 6*a* to 6*f* in the present invention and especially corresponding to FIG. 6*a;*

FIG. 7 is a perspective view showing the detailed structure of a tip portion of the discharging electrode shown in each of FIGS. 6*a* to 6*f*. In an embodiment shown in FIG. 7, an electrode plate 220 has a thickness of 0.10 mm and a discharging electrode has a pitch of 2.0 mm. Further, a height of the discharging electrode from a body portion of the electrode plate 220 is set to 2.0 mm. A second tip portion 231 and a third tip portion 232 are formed in the direction of an arrow 244 in end portions on both sides of a first tip portion 230. A central ridgeline 240 is formed in a longitudinal direction of the electrode plate 220 with respect to the first tip portion 230 and is parallel to both sides of the electrode plate. The central ridgeline 240 is formed by etching in an etching state of the electrode plate 220 shown in FIG. 10 before tip portions 230, 230-1, — are formed. The central ridgeline is formed when the tip portions 230, 230-1, — are formed as shown in FIG. 5*c*.

Figure 8A:
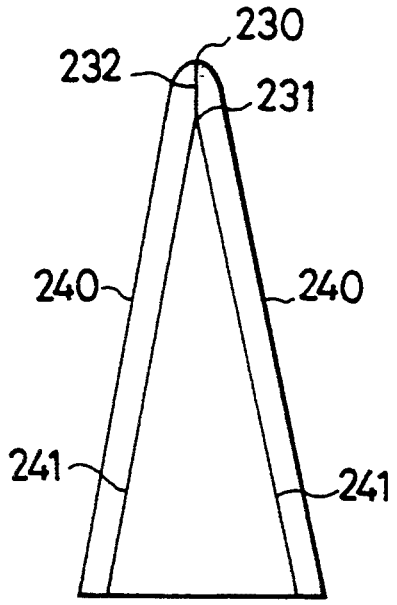

FIG. 8*a* is a front view for further enlarging tip portions of the discharging electrode shown in FIG. 7 and seen from a thickness direction of the electrode plate. The second tip portion 231 and the third tip portion 232 are projected as intersecting portions of a side ridgeline 241 and an upper ridgeline 242 so that these tip portions 231 and 232 constitute tip projections for performing the discharging operation. The first tip portion 230 is projected as an intersecting portion of the upper ridgeline 242 and the central ridgeline 240 and constitutes a tip projection for performing the discharging operation.

Figure 8B:
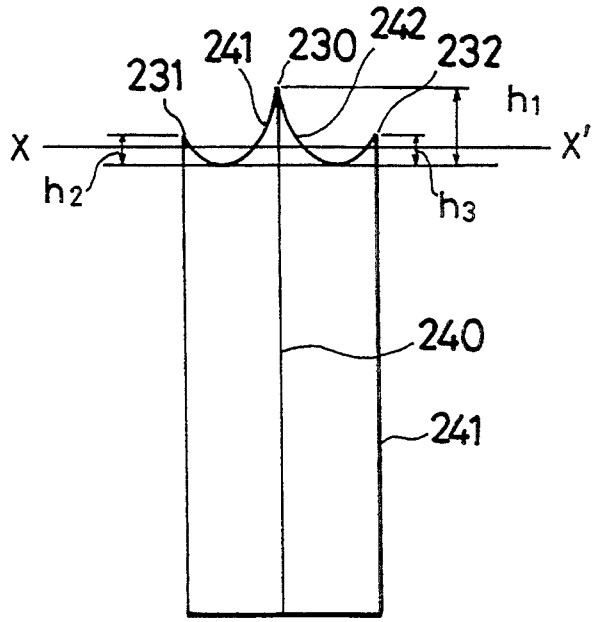
Figure 8C:
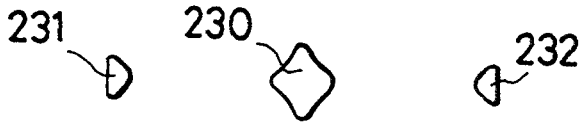
Figure 8D:
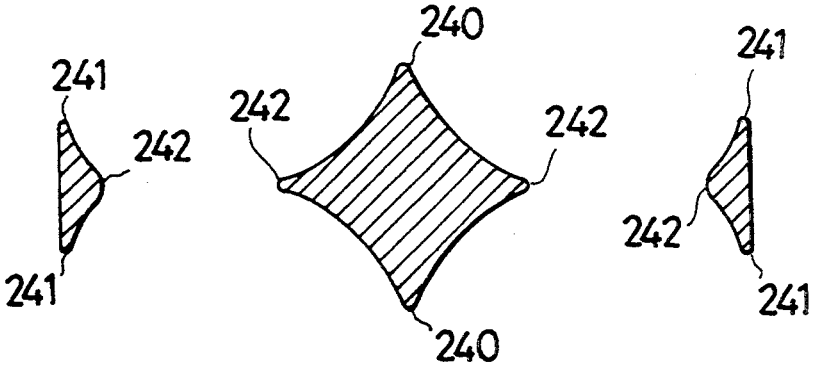

FIG. 8*b* is a side view of the discharging electrode shown in FIG. 8*a*. FIG. 8*c* is a cross-sectional view of the discharging electrode taken along line X–X′ of FIG. 8*b*. FIG. 8*d* is an enlarged view of the discharging electrode shown in FIG. 8*c*. As can be seen from FIG. 8*d*, three ridgelines are formed in sectional portions of the discharging electrode in the vicinity of the second tip portion 231 and the third tip portion 232, and four ridgelines are formed in the vicinity of the first tip portion 230.

Figure 9:
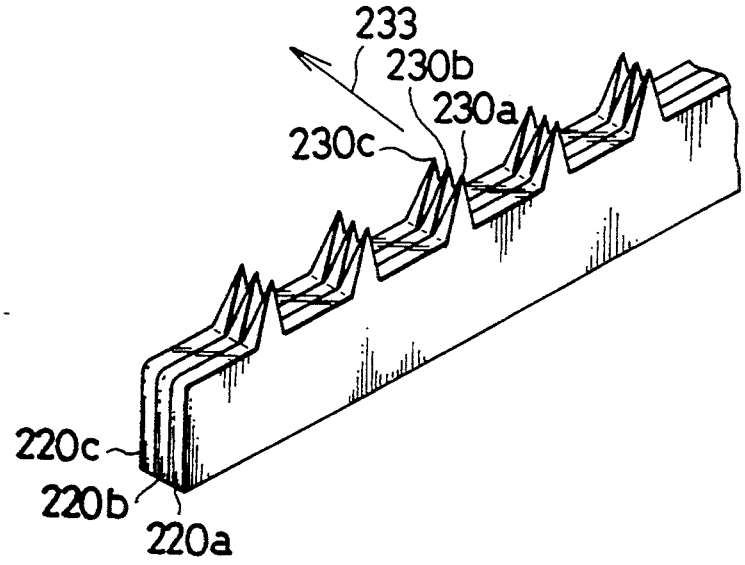
FIG. 9 is a perspective view showing a case in which a plurality of tip portions for generating a discharging electric current of a discharging electrode plate shown in FIG. 7 are overlapped and arranged in the same position with respect to an advancing direction of an image carrier.

In a schematic view of the electrode plate shown in FIG. 9, a plurality of tip portions for performing the discharging operation of the discharging electrode plate shown in FIG. 7 are overlapped such that these tip portions are located in the same position in the advancing direction of an image carrier. In FIG. 9, three electrode plates are overlapped and connected to each other and the same potential is applied to these electrode plates. Accordingly, similar to the case of FIG. 7, a group of tip portions for performing the discharging operation are approximately formed in the same position with respect to the advancing direction of the image carrier of the electrode plates. Therefore, when one tip portion is defective in the discharging operation, the other tip portions are used to continuously perform the discharging operation so that stable discharging characteristics can be obtained for a long time.

A laser printer JX9800 manufactured by SHARP corporation of Japan is used in the following experiments for evaluation of an image quality. Various kinds of electrodes in the present invention are switched in accordance with experiments so that the charger 2 shown in FIG. 3 outputs a combined image. The outputted image is an image of read data of a uniform half tone original. The image quality is evaluated in accordance with generating states of irregularities of the image quality. All of the electrodes are made of stainless steel (SUS304) in consideration of economics and durability. However, the electrodes may be constructed by selecting an alloy of copper, ion, etc. and various kinds of metals in accordance with useful life longevity.

Figure 10A:
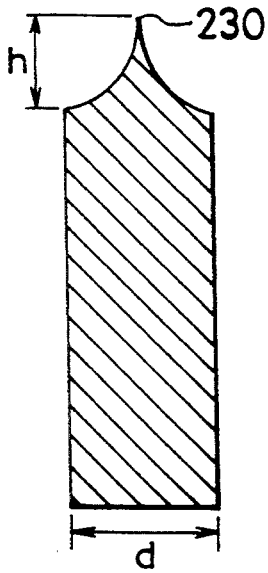
FIGS. 10*a* to 10*c* are cross-sectional views showing shapes of the tip portions of the discharging electrode having projecting portions and showing a method for measuring effective heights of the respective tip portions.
Figure 10B:
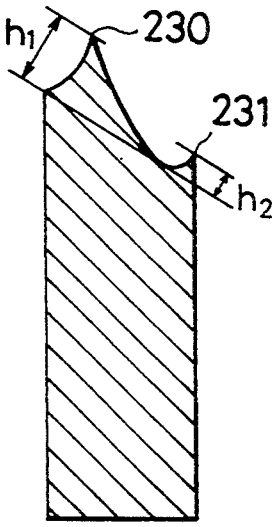
Figure 10C:
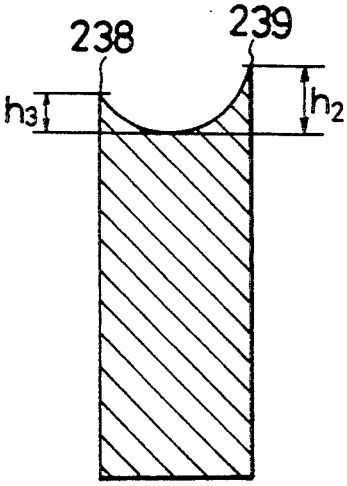

In the following table 1, a single tip portion 230 of a saw-toothed electrode for performing a discharging operation is formed as shown in FIG. 8*c*, and an image quality is evaluated with respect to a height of the single tip portion 230 and uniform discharging characteristics. In this experiment, the electrode having a shape shown in FIG. 5*c* is used in a state in which a masking agent is removed from this electrode. FIGS. 10*a* to 10*c* are schematic cross-sectional views showing the saw-toothed electrode in a sectional direction thereof and a method for measuring a size of the saw-toothed electrode.

In the following Table 1 and FIG. 10*a*, reference numeral h designates a height of the projecting tip portion 230 in unit of micrometer. Reference numeral d designates a thickness of an electrode plate 210 in unit of micrometer. The following Table 1 shows the relation between uniform discharging characteristics and the height of the projecting tip portion.

TABLE 1

| | d | | | | | | | |
|---|---|---|---|---|---|---|---|---|
| h | 100 | 75 | 60 | 50 | 25 | 12 | 10 | 5 |
| 100 | X | Δ | ○ | ◎ | ○ | — Δ | X | X |
| 50 | — | X | Δ | ◎ | ○ | Δ | X | X |

In this Table 1, the image quality is evaluated at the following four stages.

Symbol shows that no image is disturbed.

Symbol ○ shows that the image is slightly disturbed.

Symbol Δ shows that the image is disturbed, but there is no problem in practical use.

Symbol X shows that the image is greatly disturbed so that no electrode can be really used.

As can be seen from the above Table 1, the uniform discharging characteristics are most preferable when the height h of the tip portion and the thickness d of the electrode plate are equal to 50 micrometers. The saw-toothed electrode can be practically used at a height approximately ranged from 12 to 60 micrometers. When the height h is equal to or higher than 75 micrometers, it is difficult to control this height by etching and dispersion in this height is great. For example, this height is approximately dispersed by ±20 micrometers or more. Therefore, no preferable uniform discharging characteristics can be obtained in this case. Further, when the height h is equal to or higher than 75 micrometers, the image quality is reduced for a short time in view of image stability irrespective of initial aging.

In the following experiments, an electrode plate is set to have a thickness of 100 micrometers in consideration of stable holding of an electrode tip portion, aging, cleaning and economics.

Table 2 shows the results of a life of the saw-toothed electrode in the present invention in accordance with the number of projecting tip portions shown in the following Embodiments with respect to uniform discharging characteristics after 30,000 images are outputted.

TABLE 2

| | Embodiment | | | | | | |
|---|---|---|---|---|---|---|---|
| $h_1$ | 100 | 75 | 60 | 50 | 25 | 12 | 10 |
| 1 | X | Δ | ○ | ○ | Δ | X | X |
| 2 | X | ○ | ○ | ◎ | ○ | X | X |
| 3 | X | ○ | ○ | ◎ | ○ | X | X |

Embodiment 1

A discharging electrode has a single projecting tip portion. A height $h_1$ of the projecting tip portion to be discharged is variously changed as shown in the Table 2. FIG. 10*a* shows a method for measuring this height $h_1$.

Embodiment 2

The discharging electrode has two projecting tip portions. A height $h_1$ of one projecting tip portion to be discharged is variously changed as shown in the Table 2. The height $h_1$ of this projecting tip portion is provided in the Table 2. There is another projecting tip portion having a height of $h_2$ equal to or higher than 12 micrometers. The heights of the two projecting tip portions are measured as shown in FIG. 10*b* or 10*c*.

Embodiment 3

The discharging electrode has three projecting tip portions. A height $h_1$ of one projecting tip portion to be discharged is variously changed as shown in the Table 2. The height $h_1$ of this projecting tip portion is provided in the Table 2. There are another projecting tip portions having heights of $h_2$ and $h_3$ equal to or higher than 12 micrometers. The heights of the three projecting tip portions are measured as shown in FIG. 8*b*.

As can be seen from the Table 2, the uniform discharging characteristics in the case of plural tip portions are improved in comparison with those in the case of a single tip portion when the discharging electrode is aged for a long time. In the case of the Embodiment 1, a thin tip portion is formed when the height $h_1$ of the tip portion of the discharging electrode is set to 100 micrometers. Accordingly, ions of nitrogen, etc. erode the discharged tip portion by an influence of aging so that the height of the tip portion is rapidly reduced. Therefore, the image quality is reduced for a short time even in a region in which a preferable image quality is first obtained. When the height of the tip portion is set to 25 micrometers, a preferable image quality is first obtained. However, the height of the tip portion is reduced to 10 micrometers by the influence of aging for a long period so that no discharging operation can be easily performed.

The above reduction in image quality is caused in each of tip portions. In the Embodiments 2 and 3, there are a plurality of tip portions to be discharged. Accordingly, the discharging operation is continuously performed by the second and third tip portions even when the first tip portion is deteriorated. A main current of this discharge is moved between the plural tip portions arranged in the vicinity of a main electrode. Accordingly, a stable image quality can be obtained for a long time when the plural tip portions are disposed.

The discharging tip portions moved in accordance with discharge are approximately formed in the shape of a straight line with respect to the advancing direction of an image carrier so that generation of image irregularities is restrained even after aging.

FIG. 6*a* shows Embodiment 4 in which a largest projecting tip portion is formed in a central position of the discharging electrode. FIG. 6*b* shows Embodiment 5 in which the largest projecting tip portion is shifted from the central position of the discharging electrode. For example, the largest projecting tip portion is located in a position providing a distance ratio of 7:3 from both ends of the discharging electrode. The following Table 3 shows results of experiments with respect to a life of the discharging electrode and uniform discharging characteristics after 30,000 images are outputted in these Embodiments 4 and 5.

TABLE 3

| | Embodiment | | | | | | |
|---|---|---|---|---|---|---|---|
| $h_1$ | 100 | 75 | 60 | 50 | 25 | 12 | 10 |
| 4 | X | ○ | ○ | ◎ | ○ | X | X |
| 5 | X | ○ | ◎ | ◎ | ○ | Δ | X |

Embodiment 4

The discharging electrode has three projecting tip portions. A height $h_1$ of one projecting tip portion is variously changed as a parameter. Heights $h_2$ and $h_3$ of the other projecting tip portions are approximately set to 25 micrometers. The central tip portion having the height $h_1$ is located in a central position between both sides of the electrode plate as shown in FIG. 6*a*.

Embodiment 5

The discharging electrode has three projecting tip portions. A height $h_1$ of one projecting tip portion is variously changed as a parameter. Heights $h_2$ and $h_3$ of the other projecting tip portions are respectively set to 35 and 15 micrometers. The central tip portion having the height $h_1$ is located in a position providing a distance ratio of 7:8 from both sides of the electrode plate as shown in FIG. 6*b*.

As can be seen from the Table 3, when the position of the central tip portion is shifted from the central position of the electrode plate and provides the distance ratio of 7:3 and the heights of the three tip portions are changed, the discharging characteristics are improved in comparison with a case in which the central tip portion is located in the central position of the electrode plate and the heights of the plural tip portions are equal to each other. The image quality in the Embodiment 5 is improved when the heights of the tip portions are set to 12 and 60 micrometers.

Corona discharge is caused from a portion in which impedance of the discharging electrode is low. Accordingly, when the discharging electrode has a plurality of tip portions, corona discharge is caused from a first tip portion having low impedance. When the first tip portion is eroded, a discharging portion is moved from the first tip portion to second and third tip portions. Therefore, when the tip portions have different heights, a main current portion of the corona discharge is sequentially changed in comparison with a case in which the tip portions have the same height. Thus, as mentioned above, the image quality is improved in the Embodiment 5.

As mentioned above, shapes of the plural tip portions are preferably formed such that the plural tip portions have heights equal to or higher than predetermined heights for effectively causing the corona discharge and these heights are not equal to each other, but are different from each other.

In the embodiments of the present invention, a recording medium is uniformly charged in the above explanation of the charger. However, the charger can be also used as it is as a discharger for removing residual charges left on the recording medium. The transfer device 7 shown in FIG. 4 is constructed by a roller, but can be constructed by the charger of the present invention.

Discharging characteristics can be preferably stabilized for a long time by using a discharging electrode of the present invention irrespective of attachment of whiskers of silicon oxide, etc. caused in proportion to a using time of the discharging electrode. Further, since no discharging operation is easily influenced by erosion of the discharging electrode caused by ions of nitrogen, etc., a stable discharging operation can be continuously performed even when the discharging operation is performed for a long time. Therefore, it is not necessary for an operator to often clean the charger so that service or maintenance cost of the charger can be reduced.

Further, a plurality of tip portions can be simultaneously formed approximately in one position in each of projecting portions of one electrode plate for discharge. Accordingly, cost of the charger is approximately equal to that of the general charger, and can be greatly reduced in consideration of a life of the charger.

Furthermore, when a ridgeline is formed in a projecting portion and tip portions are etched and removed from the electrode plate by a discharging action for a long time, a projection can be formed on aTnew ridgeline so that duration of the discharging action can be extended.

Many widely different embodiments of the present invention may be constructed without departing from the spirit and scope of the present invention. It should be understood that the present invention is not limited to the specific embodiments described in the specification, except as defined in the appended claims.

What is claimed is:

1. A charger for performing a corona discharging, comprising:

an electrode plate formed in a shape of a panel, the panel having a longitudinal direction, a width direction and a thickness direction;

a plurality of groups of a plurality of tip projections disposed on said electrode plate, said tip projections in one of said groups being adjacent to each other in the thickness direction of said electrode plate, a plurality of said groups of said projections being arranged in the longitudinal direction of electrode plate;

a first ridgeline portion connecting said tip projections in one of said groups and running in said thickness direction; and a second ridgeline portion running in the longitudinal direction in one of said groups.

2. A charger according to claim 1, wherein a plurality of said tip projections in one of said groups are different in height from each other.

3. A charger for performing a corona discharging, comprising;

a plurality of electrode plates arranged in parallel to each other, one of said electrode plates being formed in a shape of a panel, the panel having a longitudinal direction, a width direction and a thickness direction; and a plurality of groups of a plurality of tip projections disposed on said electrode plate, said tip projections in one of said groups being adjacent to each other in the thickness direction of said electrode plate, a plurality of said groups of said projections being arranged in the longitudinal direction of said electrode plate.

4. A charger according to claim 3, wherein a plurality of said tip projections in one of said groups are different in height from each other.

* * * * *